US005915530A

United States Patent [19]

Hager

[11] Patent Number: 5,915,530

[45] Date of Patent: Jun. 29, 1999

[54] DISPOSABLE BIB AND GARBAGE BAG

[76] Inventor: Ciry Hager, 29 Dr. Frank Rd., Spring Valley, N.Y. 10977

[21] Appl. No.: 09/016,181

[22] Filed: Jan. 30, 1998

[51] Int. Cl.[6] ..... A41B 13/10

[52] U.S. Cl. ..... 2/49.3; 2/46; 2/48; 2/49.1; 2/49.2

[58] Field of Search ..... 2/46, 48, 49.1, 2/49.2, 49.3, 49.4, 49.5, 80, 81, 82, 104, 105, 106, 113, 114, 115, 69, 69.5, 88, 89, 70, 71, 72

[56] References Cited

U.S. PATENT DOCUMENTS

| | | | |
|---|---|---|---|
| 615,293 | 12/1898 | Maier | 2/49.1 |
| 1,614,126 | 1/1927 | Hart | 2/48 |
| 2,585,946 | 2/1952 | Liberman | 2/48 |
| 2,905,943 | 9/1959 | Carlisle | 2/49.3 |
| 5,483,701 | 1/1996 | Ferreyros | 2/49.2 |

*Primary Examiner*—Jeanette Chapman
*Attorney, Agent, or Firm*—Israel Nissenbaum

[57] ABSTRACT

A disposable or washable one piece high chair tray cover and bib adapted to fit over a toddler's head for use as a bib and to fit onto a high chair tray table to function as a protective stray food catcher on the tray table and between the bib and the tray table. The tray cover portion of the bib is about 29" square with three overlapping sleeves to fit over and engage the side and front edges of tray tables of varying sizes. Drawstring elements are contained within the edges of the three overlapping sleeves and are laterally exposed for drawing the sleeve snugly against a table. A key or toggle element is used to maintain the snug fit. After use, the bib is removed from the child and disengaged from the edges. The drawstrings are further tightened with the key or toggle element to form, with the bib portion, a disposable garbage bag, with self closure, for direct disposal of trapped food and debris as well as any other residual foods and items which are to be disposed of. If the bag is of a re-usable material it may be emptied, washed and re-used.

7 Claims, 2 Drawing Sheets

DISPOSABLE BIB AND GARBAGE BAG

FIELD OF THE INVENTION

This invention relates to high chair bibs used by toddlers or infants to protect clothing and particularly to disposable integral high chair table tray covers and bibs designed to collect stray food falling between the toddler or infant and the tray table.

BACKGROUND OF THE INVENTION

Bibs for use in feeding toddlers or infants, particularly while seated in high chairs are old and well known in the field. Such bibs include early bibs fastened to regular tables (U.S. Pat. No. 590,991, issued Oct. 5, 1897); those with integral food catchers (U.S. Pat. No. 2,532,932, and 2,672,614 issued Dec. 5, 1950 and Apr. 22, 1952, respectively) one with its own disposable integrated box tray (U.S. Pat. No. 4,114,199, issued Sep. 19, 1978), one adapted to car seats and strollers (U.S. Pat. No. 5,457,820, issued Oct. 17, 1995), and those with protective elements adapted to be fitted on high chair trays (e.g. U.S. Pat. No. 2,738,511 issued Mar. 20, 1956). Many of such bibs are not disposable and if disposable are difficult to use, manufacture and dispose of without spillage of food debris caught thereby.

BRIEF DESCRIPTION OF THE INVENTION

It is therefore an object of the present invention to provide a disposable, integral bib and high chair tray table cover which comprises means for customized form fitting to a high chair tray table.

It is a further object of the present invention to provide said integral bib and high chair tray table cover with means for the ready closing thereof, with debris contents, into a positively closeable disposable bags.

It is yet another object of the present invention to provide such integral bib and high chair tray table cover as an easily manufacturable item.

These and other objects, features and advantages of the present invention will become more evident from the following discussion and drawings in which:

SHORT DESCRIPTION OF THE DRAWINGS

Figure 1:
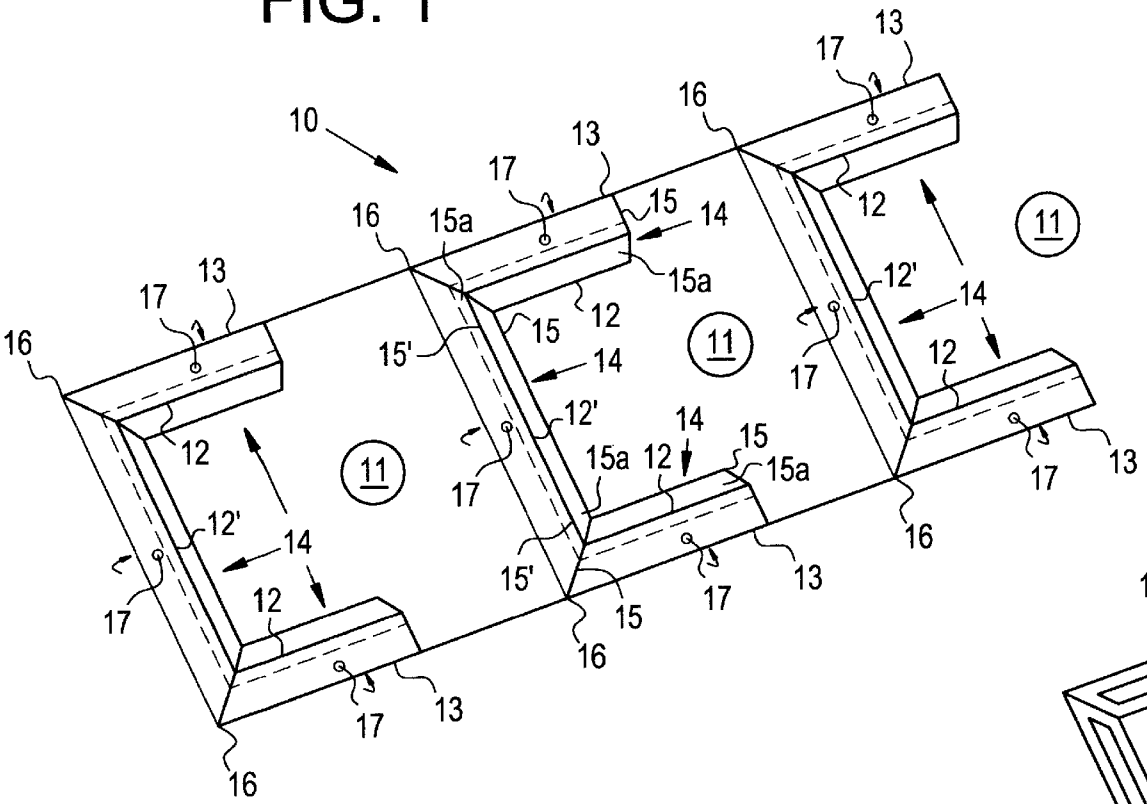
FIG. 1 depicts a roll of thermoplastic film being formed into numerous integral bib and high chair tray table covers.

Generally the present invention comprises a disposable one piece high chair tray cover and bib ("bib-tray cover") adapted to fit over a toddler's head for use as a bib and to fit onto a high chair tray table to function as a protective stray food catcher on the tray table and between the bib and the tray table. The tray cover portion of the bib is about 29" square with three overlapping sleeves to fit over and engage the side and front edges of tray tables of varying sizes. Drawstring elements are contained within the edges of the three overlapping sleeves and are laterally exposed for drawing the sleeve snugly against a table. After use, the bib is removed from the child and disengaged from the edges. The drawstrings are further tightened to form, with the bib portion, a disposable garbage bag, with self closure, for direct disposal of trapped food and debris as well as any other residual foods and items which are to be disposed of. Optionally a toggle or other fixing device or knot is used to maintain the bag closed as a garbage bag and also to keep it snugly tightened on the tray table.

The disposable bib of the present invention is comprised of a plastic film sheet having a first end with an aperture for insertion of a toddler's or infant's head therethrough for the wearing thereof. However, with the use of plastic films (the most economical disposal material) it is also necessary to ensure that the infant or toddler will not accidentally misuse it arising from ingestion choking or face covering. It is therefor important the bib and especially the tray cover portion is not loose or otherwise dislodgeable. Accordingly, with the bib of the present invention, the other end of the sheet comprises three integrally formed short sleeves (two side and one forward) adapted to be fitted on corresponding side and forward edges of a high chair tray table. Drawstring gathering means are fixedly contained within the sleeves and are accessible through cut-outs in the respective sleeves. The sleeves can be tightened and snugged to the shape and size of the tray table with use of the drawstring whereby the tray cover portion cannot be dislodged or moved by the toddler or infant. The same drawstrings are also gatherable, with removal of the bib and table cover, to form an integral, closed disposal bag. Though the bib and tray cover is described as being disposable, it may be re-used if desired after being emptied and washed if the material and replacement cost is believed to be uneconomical.

Detailed Description of the Invention

The integral bib-tray covers of the present invention are preferably manufactured from an elongated plastic film sheet which is initially die cut to provide holes for entry of toddle or infant heads for the wearing thereof (cloth may be used if re-use and washing is contemplated). A short portion of each of the sides of the film sheet is slit and folded inwardly over ribbons of plastic which are used as the drawstrings. The short folded over sections are heat sealed at the ends thereof to form engagement sleeves for the sides of the tray table on which the bib-tray table cover is placed. The ribbon may be continuous and contained within heat sealed passageways of the inward folds and across a width of the film sheet, or three respective segments of ribbon may be heat sealed to the film sheet at the respective ends of each of the segments within the inwardly folded ends and across the film sheet. The individual integral bibs-tray table covers are cut from the continuous sheet and the forward end (the end opposite the die cut hole) is inwardly folded over the ribbon extending over the width of the film sheet to form a sleeve for the forward end of the tray table. The fold lines of each of the sleeves is precut with a centrally located aperture prior to the respective placement of the ribbons therein. As a result, when the sleeves are formed, the ribbons contained therein are externally accessible for the gathering thereof, to tighten the respective sleeves against the respective contained tray table edge, to effect a snug (and non movable) fit. The gathered ribbon is either knotted or more preferably tightly held by a removable key (e.g. paper clip) or other type of toggle to maintain the snug fit.

After use is complete (the infant or toddler has been, fed albeit messily) the gathered ribbon is loosened by undoing of the knot or removal of the key and the bib-tray cover is removed from the toddler or infant and the high chair, for disposal. The bib portion of the integral bib-tray cover is folded inwardly to cover feeding debris caught on the tray cover and the ribbon gather drawstrings are again tightened but this time to effect closure of a disposable bag formed thereby.

In a manufacturing process the successive bibs-tray covers are separately stacked in a manner similar to that of disposable plastic tablecloths.

Detailed Description of the Drawings and the Preferred Embodiment

With specific reference to the drawings, in FIG. 1, a plastic film sheet 10 of a material such as polyethylene or polypropylene is die cut with apertures 11 of about eight inch diameters, sufficient for unimpeded insertion of a toddler or infant head. Plastic film ribbons 12 are situated longitudinally adjacent the side edges 13 of the film sheet 10 and enclosed within sleeve 14, formed with the side edges 13 being folded inwardly as shown by the arrows and heat sealed at 15. Axially placed film ribbons 12' are positioned adjacent scores 16, at which the individual bib-tray covers 1 are separated from each other. The edges at 16 are similarly folded over to enclose film ribbon 12' and heat sealed at 15' to form sleeves 14'. Ribbons 12 and 12' are heat sealed in place at 15*a*.

Figure 2:
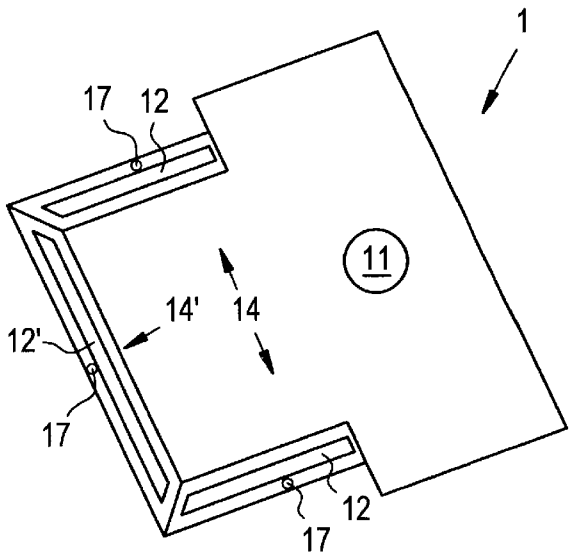
FIG. 2 is a bottom view of a formed integral bib and high chair tray table cover.
Figure 3:
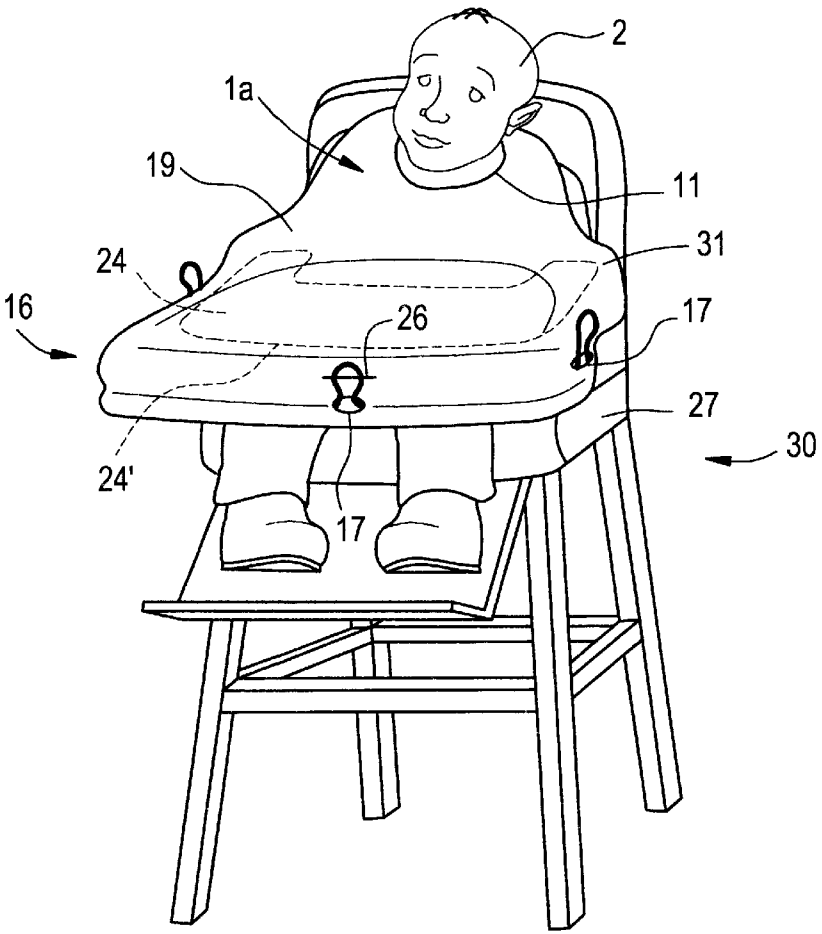
FIG. 3 is a top view of the bib-tray table cover being deployed on a child and a high chair tray table and adjustably snugged thereon.

In FIG. 2, a bib-tray cover 1 is shown from the bottom, as cut from the film sheet 10 of FIG. 1. Sleeves 14 and 14' are configured to engage the side and front edges of a high chair table tray as shown in FIG. 3. Film ribbons 12 and 12' are accessible through apertures 17 situated at the midpoints of the sleeves, whereby they are gatherable by pulling to cause the sleeves to become snugged against the high chair tray table edges 24 and 24'. Keys in the form of paper clips 26 are used to maintain the film ribbons 12 and 12' in the tightened snugged position on the tray table 31 of high chair 30.

As shown in FIG. 3, the bib segment 1*a* is placed on infant 2 with the infant's head placed through aperture 11. Integral connection segment 19 prevents food debris from falling onto the seat 27 of the high chair and the tray table cover segment 1*b* collects any spills, dribbles and drool, during the infant feeding.

Figure 4:
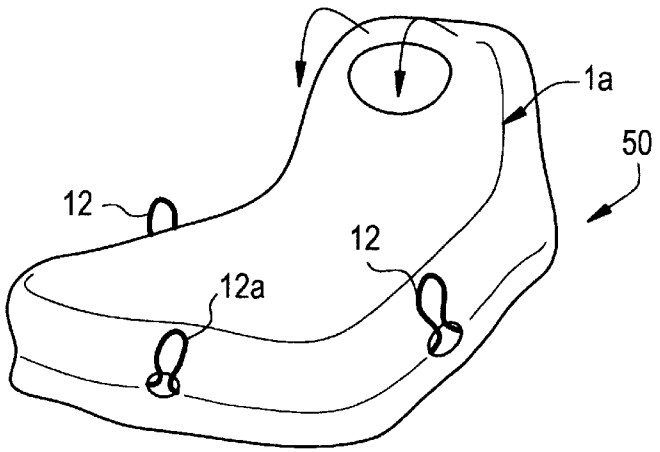
FIG. 4 depicts a used disposable bib of FIG. 3 being gathered into a disposable bag.

When the feeding is over, the bib 1*a* is slipped off the infant's head and the tray table cover segment 1*b* is removed from tray table 31. Paper clip keys 26 are removed and the drawstrings are thereby loosened to facilitate removal of the tray cover. The bib-tray table cover is then formed into a disposal bag 50, as shown in FIG. 4, by folding over of bib segment 1*a* and again gathering drawstrings 12 and 12*a* and knotting them together. Closure is sure as is disposal of the waste.

It is understood that the above description and drawings are merely exemplary of the present invention and that changes may be made to the structure of the bib of the present invention without departing from the scope of the present invention as defined in the following claims.

What is claimed is:

1. A bib comprised of a sheet having a first end with an aperture therein for insertion of a child's head therethrough for the wearing thereof, said sheet having a second, generally rectangular end opposite the first end, said rectangular end comprising three integrally formed short sleeves on a free forward end and two sides adjacent thereto, with said sleeves being adapted to engage and be fitted on corresponding end and side edges of a high chair tray table of a high chair into which the child is seated, wherein drawstring gathering means are contained within the sleeves and are accessible through cut-outs in the respective sleeves whereby the respective sleeves can be tightened and snugged to the shape and size of the tray table whereby the tray cover portion cannot be dislodged or moved by the child, and wherein the same drawstrings are also gatherable, with removal of the bib and table cover, from the child and high chair table, to form an integral, closed bag for the clean removal of debris from the high chair tray table.

2. A disposable bib comprised of a plastic film sheet having a first end with an aperture therein for insertion of a child's head therethrough for the wearing thereof, said sheet having a second, generally rectangular end opposite the first end comprising three integrally formed short sleeves on a free end and two sides adjacent thereto, with said sleeves being adapted to engage and be fitted on corresponding end and side edges of a high chair tray table of a high chair into which the child is seated, wherein drawstring gathering means are contained within the sleeves and are accessible through cut-outs in the respective sleeves whereby the respective sleeves can be tightened and snugged to the shape and size of the tray table whereby the tray cover portion cannot be dislodged or moved by the child, and wherein the same drawstrings are also gatherable, with removal of the bib and table cover, from the child and high chair table, to form an integral, closed disposal bag.

3. The bib of claim 2, wherein the respective sleeves comprise respective passageways along the respective lengths for containing the drawstring gathering means and wherein the drawstring gathering means comprise at least one ribbon of a plastic material contained within said passageways of the respective sleeves.

4. The bib of claim 3, wherein the passageways are integrated with each other for the continuous passage of a continuous ribbon therethrough.

5. The bib of claim 3, wherein said passageways are comprised of inward folds of the free ends of the respective sleeves partially integrated with the sheet.

6. The bib of claim 5, wherein multiple integral bibs-tray table covers are cut from a continuous sheet with a forward end opposite an end having the aperture therein, wherein the forward end is inwardly folded over a ribbon extending over the width of the film sheet to form a sleeve with contained drawstring gathering means therein and for fitting to the forward end of the tray table and wherein the two side ends are each inwardly folded over respective ribbons extending over a portion of the length of the sheet to form respective side sleeves with contained drawstring gathering means, for fitting to side ends of the tray table, wherein each of the sleeves is precut with a centrally located aperture prior to the respective placement of the ribbons therein, whereby ribbons contained the respective sleeves are externally accessible for the gathering thereof, to temporarily tighten the respective sleeves against the respective contained tray table edge, to effect a snug fit and for tightening into the disposal bag thereafter.

7. The bib of claim 6, wherein the bib comprises removable toggle means for tightening the ribbons to effect the tightening for placement on the tray and for forming of the disposal bag.

* * * * *